United States Patent [19]

Gorsich et al.

[11] 4,003,857

[45] Jan. 18, 1977

[54] CONCENTRATED AQUEOUS OLEFINS SULFONATES CONTAINING CARBOXYLIC ACID SALT ANTI-GELLING AGENTS

[75] Inventors: Richard D. Gorsich; William J. DeWitt, both of Baton Rouge, La.

[73] Assignee: Ethyl Corporation, Richmond, Va.

[22] Filed: Dec. 17, 1973

[21] Appl. No.: 425,198

[52] U.S. Cl. ..... 252/546; 252/117; 252/121; 252/153; 252/173; 252/541; 252/547; 252/552; 252/555; 252/DIG. 14; 260/513 R

[51] Int. Cl.[2] ..... C11D 1/14; C11D 1/37; C11D 3/20; C11D 11/04

[58] Field of Search ..... 252/121, 117, 536, 555, 252/DIG. 14, 523, 527, 528, 541, 546, 547, 173, 552, 153; 260/513 R

[56] References Cited

UNITED STATES PATENTS

| | | | |
|---|---|---|---|
| 3,415,753 | 12/1968 | Stein | 252/121 |
| 3,444,087 | 5/1969 | Eccles | 252/536 |
| 3,488,384 | 1/1970 | Kessler | 260/513 |
| 3,502,716 | 3/1970 | Kite | 260/513 |
| 3,533,954 | 10/1970 | Davies | 252/110 |
| 3,554,916 | 1/1971 | Kerfoot | 252/558 X |
| 3,594,323 | 7/1971 | Taylor | 252/526 |
| 3,630,929 | 12/1971 | van Dijk | 252/136 |
| 3,759,834 | 9/1973 | Parke | 252/110 |
| 3,808,156 | 4/1974 | Gorsich et al. | 252/545 |
| 3,852,221 | 12/1974 | Bentley | 252/548 |
| 3,893,955 | 7/1975 | Hewitt | 252/551 |

*Primary Examiner*—Dennis L. Albrecht
*Attorney, Agent, or Firm*—Donald L. Johnson; John F. Sieberth; Shelton B. McAnelly

[57] ABSTRACT

The present invention discloses novel aqueous olefin sulfonate compositions containing 50 percent or less of water and which can be conducted through piping making it practical to transport them in bulk containers over considerable distances. The compositions are useful to produce novel detergent concentrates which have excellent "anti-gel" and "body" characteristics. The compositions of the invention contain carboxylic acid salts in addition to the sulfonic acid salts. A preferred carboxylic acid salt is sodium formate.

12 Claims, 3 Drawing Figures

CONCENTRATED AQUEOUS OLEFINS SULFONATES CONTAINING CARBOXYLIC ACID SALT ANTI-GELLING AGENTS

BACKGROUND OF THE INVENTION

1. Field of the Invention

This invention relates to olefin sulfonate compositions which have useful detergent properties and to the preparation of novel "high-active" compositions useful for preparing them. In greater particularity, the invention relates to concentrated olefin sulfonate (water soluble sulfonic acid salts) compositions, to a novel process for producing them and to anti-gel and "bodied" liquid detergent compositions containing mixtures of sulfonic acid salts and carboxylic acid salts.

2. Description of the Prior Art

The prior art production of detergents using olefin sulfonates (AOS) has been faced with numerous difficulties largely because of the limited water solubility of the olefin sulfonates and because of viscosity problems and gelling tendencies with liquid detergent concentrates containing them. Aqueous solutions of olefin sulfonates are quite thick when the salt concentration is 30–40 percent (weight) or greater and such solutions have a tendency to form gels on standing so that bulk handling of such concentrated solutions is difficult if not impossible. If one uses less concentrated solutins to reduce the handling problems, then the increased water content makes shipping costs per pound of contained sulfonate so expensive as to limit severely the size of the geographical area that can be supplied by an individual sulfonation plant making it necessary to have a plurality of small sulfonation facilities in numerous geographical locations rather than one large plant to serve a large geographical area. This is obviously disadvantageous in numerous ways leading to higher prices. On the other hand, where one desires detergent formulations in which the AOS concentrate is used as a component, the water present in such AOS limits the amount of AOS that can be incorporated into the liquid detergent formulation. In addition, where the AOS concentrate is to be used in "dry" detergent products, minimizing the water content of the AOS concentrate reduces spray drying costs.

Olefin sulfonates useful for detergent purposes are described in detail in the prior art. Compositions are disclosed in U.S. Pat. No. 3,332,880 as consisting of a mixture of three principla components containing from about 10 to about 24 carbon atoms; viz, alkene sulfonic acid salts, hydroxy alkyl sulfonic acid salts and disulfonic acid salts in weight proportions of from about 30 to about 70 percent, from about 20 to about 70 percent, and from about 2 to about 15 percent, respectively. As described in the aforementioned patent, such salt compositions can be produced in various ways. A preferred process for producing olefin sulfonates involves the sulfonation of olefins followed by saponification of the sulfonation product with an appropriate base. The chemical reactions of the saponification step require the combination of an oil phase and a water phase to produce a water phase organic salt system having adequate water present to produce a liquid system within the limits imposed by the solubility of the organic salts present. Thus the prior art saponification operation itself usually is limited by the solubility of the olefin sulfonates. As a practical matter, one generally adjusts the amount of water used in prior art hydrolysis to provide a sulfonate product containing about 30–40 wt. percent salt and 60–70 wt. percent water. This product usually is combined subsequently with various conventional detergent additives such as amides, amine oxides and ethoxy sulfates as described in U.S. Pat. application Ser. No. 201,197, filed Nov. 22, 1971, the text of which is herein incorporated by reference.

In contrast to the gelling problem encountered with the sulfonate detergent compositions that contain from about 25 to about 40 percent olefin sulfonate and described in Ser. No. 201,197, less-concentrated detergent compositions which contain from about 5 to about 25 percent olefin sulfonate have an entirely different problem. These compositions frequently lack "body", appearing undesirably thin or watery. This aspect is discussed in U.S. Pat. No. 3,741,915. In regard to "pumpable" "high active" super concentrates of olefin sulfonates which have about 50 percent water or less, this appears to be an art area that has seen little or no attention in the patent literature.

BRIEF SUMMARY OF THE INVENTION

The present invention provides water soluble olefin sulfonate detergent compositions containing from about 5 to about 57 wt. percent water plus a salt of a carboxylic acid. The compositions are suitably transported in bulk containers and via piping. The present invention also provides a process for producing the detergent compositions and provides detergent formulations based on the detergent compositions wherein the "body" and gelling properties are controlled.

DETAILED DESCRIPTION OF THE INVENTION

Figure 1:
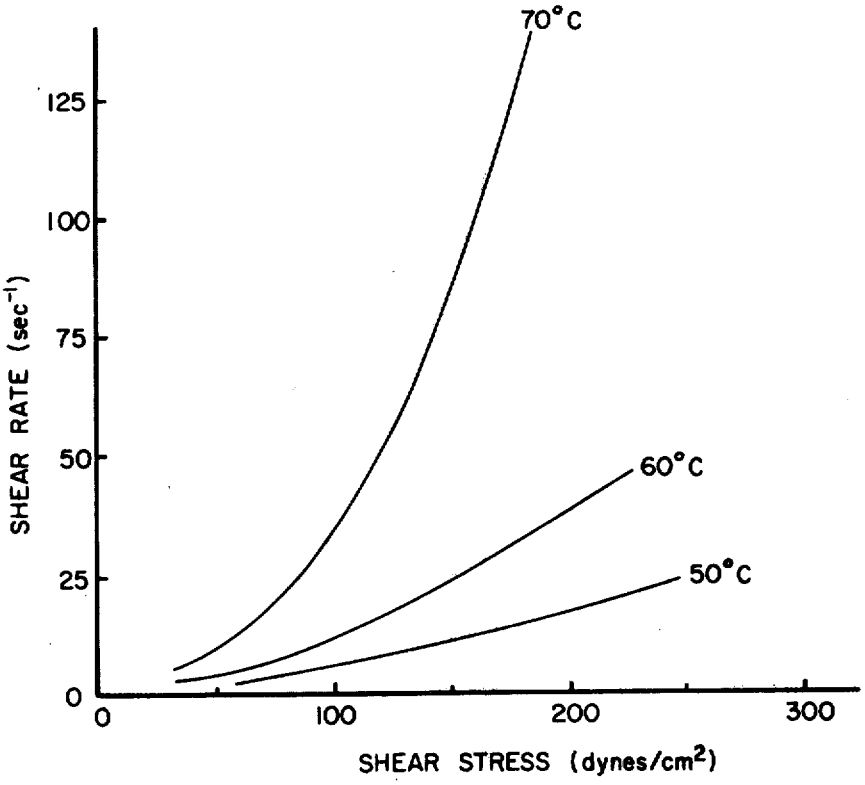
FIGS. 1, 2 and 3 show viscosity data for high active detergent compositions of Examples I, II and IV, respectively.

Thus it is considered surprising that a way has been found to alleviate the foregoing problems connected with the production, transportion and utilization of olefin sulfonate detergents. All of the prior art problem areas mentioned can be alleviated to a very significant extent through the use of a comparatively simple low cost additive. This additive makes it possible to produce high active concentrates which are pumpable at moderate temperatures even though they may contain considerably less than 50 percent water. The same additive acts as an anti-gel component where that property is desired and as a body increasing component where that property is desired. Thus where the additive is initially used for purposes of obtaining a high active concentrate, it is not necessary to remove the additive for subsequent use of the concentrate or of compositions derived from it.

Aqueous sulfonate compositions which possess the foregoing described desirable characteristics are readily obtained by the incorporation into otherwise conventional aqueous olefin sulfonate systems of a monobasic carboxylic acid salt. Various carboxylic acid salts which do not react adversely with other materials present in the compositions are suitably used as defined hereinafter. Preferred salts are water soluble alkali-metal, ammonium,lower alkanol ammonium and lower alkyl ammonium salts of the formula RCOOM wherein R is hydrogen or alkyl having up to about 9 carbon atoms. Especially preferred salts are alkali metal salts of lower carbocylic acids such as acetates or formates. Sodium salts are usually preferred, as are formate salts. A preferred salt is sodium formate. Other useful salts are sodium acetate, potassium formate and potassium acetate. Preferred high active compositions contain from about 40 to about 87 weight percent of olefin sulfonate having from about 10 to about 24 carbon atoms per molecule, from about 3 to about 50 weight percent of the carboxylic acid salt as defined, and the balance water, usually from about 5 to about 57 percent by weight. In these systems the weight ratio of olefin sulfonate to carboxylic acid salt is from about 87:3 to about 4:5. Such systems will move through pipes at moderate temperatures of from about 70° to about 100° C. In the absence of the carboxylic acid salts, aqueous olefin sulfonate systems more concentrated than about 40 percent sulfonic acid salt by weight ususally form gels and do not move readily through pipes at any temperature.

Especially preferred high active systems contain from about 50 to about 70 weight percent olefin sulfonate, from about 3 to about 25 weight percent carboxylic acid salts and from about 10 to about 47 weight percent water. In these systems the weight ratio of the olefin sulfonate to the carboxylic acid salts is from about 70:3 to about 2:1. Even more preferred systems for many applications contain from about 60 to about 70 weight percent olefin sulfonate salts, from about 4 to about 10 weight percent carboxylic acid salts and from about 20 to about 36 weight percent water. In these systems the weight ratio of olefin sulfonate to carboxylic acid salt is from about 70:4 to about 6:1.

Preferably the systems containing the olefin sulfonate, the carboxylic acid salts and water are formed in a novel hydrolysis process applied to a product obtained by sulfonating olefins using conventional sulfonation processes such as those of the prior art. In this hydrolysis process, carboxylic acid salts used as additive as defined herein or suitable precursors thereof are mingled with (1) an acid mixture of sulfonic acids and/or sultones such as that produced by the sulfonation of olefins with $SO_3$ as described heretofore; (2) water, and (3) a suitable hydrolysis base such as NaOH, KOH, or $NH_4OH$, prior to or concurrently with the hydrolysis reaction and the mixture is batch hydrolyzed or is forced through a pipe system continuous hydrolyzer using a pressure which is greater than autogeneous pressure, preferably using a gear pump or piston pump or a screw conveyor system that provides good mixing and contact. Hydrolysis occurs in the pipe system. The amounts of the carboxylic acid salts, of the base, and of water used for the hydrolysis are preferably proportioned to provide directly a desired product system containing the previously described compositions containing typically 40 to 87 percent of olefin sulfonate salts. Various ways for incorporating the carboxylic acid salts can be used. The salts can be added as such or generated in situ as for example for feeding a suitable acid, such as formic acid, to the base hydrolysis solution prior to a batch or continuous hydrolyzer.

Thus, it is seen that a novel overall process is provided for producing a fluid olefin sulfonate system from olefins having from about 10 to about 24 carbon atoms per molecule wherein a sulfonation addition product is first formed by reacting from about 0.85 to about 1.3 mols of $SO_3$ with about one mol of olefin having from about 10 to about 24 carbon atoms at a temperature of about 0° to about 100° C over a period of about 0.1 to about 60 seconds. In a second step of the process, sulfonation addition product is reacted with aqueous sodium, potassium or ammonium hydroxide in the presence of an alkali metal, ammonium, lower alkanol ammonium or lower alkyl ammonium salt of a monobasic carboxylic acid having up to about 10 carbon atoms per molecule, preferably at a temperature of from 50 to about 200° C. The amount of water present in the system at the second step ranges from about 5 to about 57 percent by weight, preferably from about 10 to about 47 percent, especially from about 20 to about 36 percent. The amount of carboxylic salt or precursor fed is proportioned on a basis of the amount of olefin sulfonate salt produced to provide a ratio of the olefin sulfonate salt relative to the monobasic carboxylic acid salt of from about 87:3 to about 4:5, preferably from about 70:3 to about 2:1, especially from about 70:4 to about 6:1. The weight ratio of total salt (olefin sulfonate salt plus carboxylic acid salt) to water is from about 95:5 to about 43:57, preferably from about 9:1 to about 53:47, especially from about 8:1 to about 64:36. Preferably any unreacted olefins are removed from the sulfonation addition product after the second step. Any suitable process may be used for such removal of unreacted olefins; however, solvent extraction with a suitable solvent such as petroleum ether, pentane, or hexane is preferred.

Preferably sodium hydroxide or potassium hydroxide is used in hydrolysis. Preferably the temperature of the hydrolysis is from about 90° C to about 150° C.

Preferably the hydroxide used is sodium hydroxide or potassium hydroxide and the monobasic carboxylic acid salt is sodium or potassium formate or acetate, especially sodium formate.

The super-active carboxylic acid salt-sulfonic acid salt aqueous concentrates of the present invention, although preferably made by the foregoing hydrolysis in the presence of carboxylic acid salt, can be produced in other ways. For example, 20 to 40 weight percent, typically a 30 weight percent, aqueous solution of olefin sulfonate salt conventionally produced by the $SO_3$ sulfonation of olefins followed by a conventional hydrolysis with NaOH as described in U.S. Pat. application Ser. No. 201,197, filed Nov. 22, 1971, but without the co-present carboxylic acid salt, is about as concentrated a system as is desirably handled using prior art techniques. Such a 30 weight percent sulfonate salt system can be converted readily to a more concentrated system, typically to a 65 percent or higher sulfonate salt composition, for example, by combining it with an effective amount of carboxylic acid salt at a temperature of from about room temperature to about 200° C, and then removing excess water by vaporization at a pressure of from about 1/4 to about 75 atmospheres. This procedure is particularly useful, for example, when one has existing hydrolysis and formulation equipment and local markets based on old practice and desires to expand the sulfonation operations and area served thereby via the production of super-active concentrate which can be economically shipped greater distances to remotely located formulation equipment.

The foregoing high-active sulfonate compositions can be used in various ways to produce detergent formulations. Of course, it is evident that such systems can be merely dried to remove all or part of the water contained therein to form a substantially solid material of various forms and shapes ranging from powder to bars. This can be pulverized to form a finer powder or granular system or compacted into larger sizes. Furthermore, these operations can be combined with various blending operations whereby other conventional detergent adjuvants, including without limitation, actives, binders, builders, perfumes, pigments, dyes, pH control agents, anti-redeposition agents, buffers, and the like, hereinafter discussed in greater detail, are incorporated into the final product. Alternately the high-active sulfonate compositions are readily extruded, or spray dried where the anti-gel agent aids atomization by the spray dryer nozzles or spinning disc.

Where a light detergent product is desired such as a light duty liquid detergent, the high-active sulfonate compositions are readily transported by rail, truck or otherwise to a remote location and thereafter diluted with water and made into liquid concentrates containing from about 5 to about 40 weight percent of olefin sulfonate salts. Such diluted systems are in general similar to concentrated liquid detergents known in the art such as liquid dishwashing detergent concentrates described in U.S. Pat. application Ser. No. 201,197, filed Nov. 22, 1971.

In such detergent compositions the presence of carboxylic acid salts carried through from the super-active concentrates is usually highly beneficial as will be shown hereinafter; however, removal of the salts if desired, can be accomplished in any suitable way, such as by acidification and stripping of volatile carboxylic acid. On the other hand, the benefits to be realized from the retention of the carboxylic acid salts usually are so great that in many instances it is desired, not to remove them to produce formulations, but to add additional carboxylic acid salt, either in the form of more of the same carboxylic acid salt used initially or of a different salt. Thus, for example, while about 5 to about 10 weight percent of the carboxylate salt may be adequate to produce a super-active concentrate that is readily handled in shipment and in further processing thereof, finished formulations may be desired that have up to several times this amount up to about a 4:5 weight ratio of olefin sulfonate salts to carboxylic acid salts.

Accordingly, the present invention includes various fluid detergent formulations which contain the carboxylic acid salts carried through from the high-active concentrates and formulations with additional carboxylic acid salt. Such fluid detergent compositions consist essentially of (A) water-soluble olefin sulfonate having from about 10 to about 24 carbon atoms in the molecule; plus (B) an alkali metal, ammonium, lower alkanol ammonium or lower alkyl ammonium salt of a monobasic carboxylic acid of up to about 10 carbon atoms per molecule; plus (C) one or more of amide, amine oxide or alkyl ether sulfate and plus (D) water. Amide used in these formulations is fatty acid mono- or di-lower alkanol amide, the fatty acid groups thereof containing from about 10 to about 14 carbon atoms. Amine oxide used in these formulations is tertiary amine oxide of the formula $R_1R_2R_3N \quad O$ wherein $R_1$ and $R_2$ are lower alkyl radicals or hydroxy lower alkyl radicals having from 1 to about 4 carbon atoms and $R_3$ is a saturated aliphatic radical having from about 10 to about 20 carbon atoms, preferably from about 12 to about 14 carbon atoms, and wherein $R_1$ and $R_2$ can be joined together with N in a ring structure such as a morpholine ring. Alkyl ether sulfate used in these formulations has the formula $RO(CaH_{2a}O)_xSO_3M$ wherein R is an alkyl chain of from about 10 to about 18 carbon atoms; $x$ is a value from 1 to about 5, $a$ is 2 or 3, or combination where some $a$ is 2 and some 3, the cation of said olefin sulfonate and the cation M of said sulfate being independently selected from the group consisting of alkali metal, ammonium, lower alkanol ammonium or lower alkyl ammonium. The aqueous composition contains from about 10 to about 90 percent by weight of olefin sulfonate, carboxylic acid salt, amide, amine oxide and alkyl ether sulfate. The weight ratio of olefin sulfonate to carboxylic acid salt is from about 87:3 to about 4:5 on a weight basis and the weight ratio of olefin sulfonate to amide, amine oxide and alkyl ether sulfate is from about 15:1 to about 1:3.

Preferably the carboxylic acid salt used in the detergent formulation is an alkali metal salt and preferably it is also a formate or acetate salt. Alkali metal formate salts are preferred, especially sodium formate. Preferably the weight ratio of olefin sulfonate to component C is from about 10:1 to about 1:2. Preferably the weight ratio of olefin sulfonate to carboxylic acid salt is from about 70:3 to about 2:1, especially from about 70:4 to about 6:1. Preferably the amount of A is from about 5 to about 35 percent by weight.

In one class of compositions the amount of olefin sulfonate preferably is from about 5 to about 35 percent by weight and the weight ratio of olefin sulfonate to carboxylic acid salt is from about 70:3 to about 2:1.

In another preferred class of compositions, the amount of olefin sulfonate is from about 5 to about 25 percent by weight. This class generally is more subject to the body lack problems than are compositions of 25 percent and higher olefin sulfonate content and when that problem is faced an olefin sulfonate to carboxylic acid weight ratio of from about 8:1 to about 4:5 is usually preferred, especially so when the amount of olefin sulfonate is from about 5 to about 20 percent by weight. Where body enhancement is desired, it is preferred also to have present at least one of amide or amine oxide as defined previously in a weight ratio of olefin sulfonate to amide and amine oxide of from about 10:1 to about 1:1. In some instances, the intermediate composition range of from about 10 to about 25 percent of olefin sulfonate by weight is especially subject at the same time or at different times, e.g. at different times of the year or at different temperatures, to the disadvantage of a lack of body while in the bottle and also to the bottle cap gelling problem. Such an intermediate composition preferably uses the ratios of olefin sulfonate to carboxylic acid salt of the previous paragraph and where body enhancement is desired, also uses amine or amide oxide or both in the weight ratio of olefin sulfonate to amide and amine oxide of 10:1 to 1:1.

Especially preferred aqueous detergent formulations contain from about 5 to about 12 percent by weight of olefin sulfonate, amide or amine oxide or both in a weight ratio of olefin sulfonate to amide and amine oxide of from about 10:1 to about 1:1, have a weight ratio of olefin sulfonate to carboxylic acid salt of from about 8:1 to about 4:5.

CARBOXYLIC ACID SALTS

Carboxylic acid salts useful in the process and in the compositions of the present invention are selected from those which are water soluble and which have the desired properties while avoiding undesired properties such as odor, poor biodegradability, toxicity to humans, fish, plant life, etc. In general, the salts of dibasic acids such as oxalic acid and maleic acid, although useful, are not desired because of various reasons, such as toxicity, cost effectiveness, etc. The salt cations are not particularly critical as long as the salt itself is water soluble. On the other hand, certain salts such as the alkali metal salts are usually preferred from a cost-effectivensss or other viewpoint. Thus simple comparatively inexpensive cations such as the alkali metals or ammonium are preferred. Sodium and potassium salts are preferred, especially the former. Other soluble salt cations also useful include the alkanol ammonium and alkyl ammonium, particularly the lower alkanol ammonium and lower alkyl ammonium salts having from about two to about six carbon atoms to each of their (cation) carbon chain groups. Typical salts have mono- or diethanol ammonium, mono- or diisopropanol ammonium, ethyl ammonium, isopropyl ammonium and the like, cations.

The anion component of the carboxylic acid salts is preferably of the formula $(RCOO)^-$ wherein R is H or alkly having up to about 9 carbon atoms. In general, the preferred anions are those with the lesser numbers of carbon atoms such as the formates, acetates and propionates. Of these, the formates are preferred from cost effectiveness considerations and because the hydrolysis characteristics of formic acid salts are such that hydrolysis to the free acid is virtually negligible at pH's higher than about 6 where much of the utility of detergent formulations resides. Thus sodium formate, potassium formate, sodium acetate, potassium acetate, sodium propionate and potassium propionate are the most preferred carboxylic acid salts. Lithium salts, although useful, are usually less desired than their sodium and potassium counterparts.

OLEFIN SULFONATE

The term olefin sulfonates is used herein to means compounds which can be produced by the sulfonation of olefins with sulfur trioxide, followed by neutralization of the acid reaction mixture under conditions such that any sultones which have been formed in the reaction are hydrolyzed to give the corresponding alkene, alkoxy or hydroxy-alkane sulfonates (as salts). The sulfur trioxide may be liquid or gaseous, and is usually, but not necessarily, diluted by inert diluents, for example by liquid $SO_2$, chlorinated hydrocarbon, etc., when used in the liquid form, or by air, nitrogen, gaseous $SO_2$, etc., when used in the gaseous form. U.S. Pat. No. 3,332,878 describes preferred AOS components and mixtures in great detail and describes processes whereby the components can be produced more or less individually from various starting materials for blending to produce mixtures. Other U.S. patents describing various olefin sulfonation and hydrolysis processes include U.S. Pat. Nos. 2,061,617; 2,697,031; 3,169,142; 3,488,384; 3,531,518; and 3,755,429. Olefins useful in the present process can be obtained a number of different ways as discussed in patents cited herein. For example, they can be obtained by wax cracking, dehydration of alcohols, or by ethylene build-up as taught by U.S. Pat. No. 3,663,647.

U.S. Pat. No. 3,332,878 also describes in detail various adjuvants used in detergent formulations and describes processes for preparing them. For example, it discusses alkyl ether sulfates, cations of detergent ingredients, builders, amides, etc.

Preferred olefin sulfonates are derivatives of monoolefins and are predominantly of a structure with a sulfonate (or sulfonic acid salt) group attached to a terminal C atom. Sulfonates of substantially open chain carbon skeleton structures are preferred, especially those with unbranched carbon chains. Sulfonates whose sulfonate groups are attached to non-terminal carbon atoms such as those produced by the sulfonation of internal olefins are also desirable, particularly when such are components of mixed systems containing derivatives of vinyl, vinylidene and internal types of olefins as taught in U.S. Pat. application Ser. No. 278,554, filed Aug. 7, 1972. Although various pure olefins may be sulfonated individually and the products blended before or after hydrolysis to produce mixtures as herein described, the sulfonation of mixtures of olefins is preferred, typically mixtures having up to about 20 percent $C_{12}$, up to about 100 percent $C_{14}$ and up to about 80 percent $C_{16}$, and which preferably contain predominantly straight chain terminal olefins, and may include up to about 40 mol percent of beta branched terminal olefins and up to about 75 mol percent of internal olefins, the latter preferably being predominantly straight chain. Preferred olefin mixtures are typically obtained by the so-called Ziegler process of chain growth with ethylene on a lower trialkyl aluminum compound to produce a higher alkyl trialkyl aluminum as described in U.S. Pat. No. 2,826,598 followed by an ethylene displacement liberating the desired higher molecular weight olefins. Such an ethylene displacement is described in U.S. Pat. No. 3,389,161. The process is also described in Annalen der Chemie, Vol. 629, Nos. 1–3, pp. 172–198. The olefins thus obtained are acyclic in structure and almost exclusively mono olefins. Typical olefins include decene-1, undecene-1, dodecene-1, tridecene-1, tetradecene-1, pentadecene-1, hexadecene-1, heptadecene-1, octadecene-1, nonadecene-1, eicosene-1, heneicosene-1, docosene-1, tricosene-1, and tetracosene-1. Other olefins include 2-ethyl octene-1, 2-methyl decene-1, 2-methyl undecene-1, 2-methyl dodecene-1, 2-ethyl dodecene-1, 2-methyl tridecene-1,2-ethyl tridecene-1, 2-methyl tetradecene-1, 2-ethyl tetradecene-1, 2-methyl hexadecene-1, 2-ethyl octadecene-1, decene-2, decene-3, decene-4, dodecene-2, tetradecene-3, hexadecene-4, octadecene-2, eicosene-2, 3-methyl dodecene-2, and the like.

The sulfonates thus produced are essentially acyclic and contain a wide spectrum of open chain compounds in two general classes of unsaturated and hydroxyalkane compounds some of which have two or more sulfonic acid groups and which frequently are called disulfonates. The compounds are predominantly alkene sulfonic acid salts and hydroxyalkane sulfonic acid salts many of which are described individually or in groups in U.S. Pat. Nos. 2,061,617; 2,061,618; 2,061,619; 2,061,620; 2,160,343; 2,187,244; 2,365,783; 2,383,737; 2,383,738; 2,486,922; 2,529,538; 2,923,728; 3,169,142; 3,259,645; 3,270,038; 3,328,460; 3,332,880; 3,346,505; 3,350,428; 3,384,597; 3,409,637; 3,420,875; 3,424,693; 3,424,694; 3,428,654; 3,444,087; 3,444,191; 3,488,384; 3,506,580; 3,531,518; 3,535,339; 3,544,475; 3,565,809; and Re 22,548.

The following general equations indicate the various configurations of typical alkene and hydroxy alkane sulfonic acids and salts. Additional specific details of the configuration of the usual acids and salts are given at length in U.S. Pat. No. 3,332,880. Although there is some variation in the properties of the various salts and of the proportions of the various salts in usual olefin sulfonate mixtures, the class as a whole is characterized by good but limited solubility in water and by a tendency to the formation of gels in aqueous systems that contain more than about 40 percent by weight of sulfonic acid salts.

Thus preferred olefin sulfonate salts are represented by the following fundamental structures:

I. $R(CR_2)_xCR{=}CR(CR_2)_yR$ wherein

R is hydrogen, alkyl, hydroxyl, or sulfonic acid group ($-SO_3M$), provided that the total number of hydroxyl groups is 0, 1 or 2 and the total number of sulfonic acid groups is 1, 2 or 3.

M is hydrogen, alkali metal, ammonium, lower alkanol ammonium, or lower alkyl ammonium.

$x$ is an integer.

$y$ is 0 or an integer, provided that the total number of carbon atoms in the molecule is from about 10 to about 24.

II. $R(CR_2)_xR$ wherein the terms are as with structure I, except that the total number of hydroxyl groups is 1 or 2.

It will be recognized that the reaction of olefins with $SO_3$ is considered as producing a mixture containing predominantly I and sultones as shown hereinafter where M is hydrogen (acid). On hydrolysis of such a mixture with base, the sultones are converted to I (salt) and II (salt), the latter usually predominanting, and the I (acid) is converted to I (salt).

Sultones are represented by the formula:

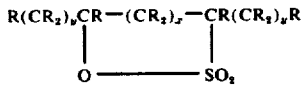

wherein the terms are as with the foregoing olefin sulfonate structure I, except that $x$ is 0, 1 or 2, and 1 or 2 of the R can be OH or sulfonic acid group ($-SO_3M$).

Preferred olefin mixtures sulfonated to produce olefin sulfonates useful in accordance with the present invention contain on a mol percent basis from about 60 to about 95 percent vinyl olefins, from about 3 to about 40 percent vinylidene olefins and from about 2 to about 35 percent internal olefins. Other useful olefin mixtures contain from about 60 to about 90, preferably 80–90, mol percent vinyl olefins; from about 3 to about 30, preferably 5–12, mol percent vinylidene olefins; and from about 3 to about 12, preferably 5–12, mol percent internal olefins.

Preferred olefin sulfonates are the alkali metal salts, such as sodium or potassium salts, especially the former.

ALCOHOL ETHER SULFATE COMPONENT

The alcohol ether sulfate component optionally used in compositions in accordance with the present invention is typically obtained as an aqueous system of the product of sulfation of ethoxylated alcohols with chlorosulfonic acid. The alcohols ethoxylated are pure alkanols or mixtures of alcohols ranging from about 10 to about 18 carbon atoms per molecule. Typical mixtures of alcohols are center cut or whole cut coconut alcohols of natural or synthetic origin, preferably synthetic as produced in accordance with U.S. Pat. Nos. 3,384,651 and 3,415,861. The ethoxylated derivatives preferably average from about 1 to about 5 ethylene oxide units per molecule. As is known, these sulfates also suitably contain propylene oxide units either solely or together with ethylene oxide units.

The sulfated material is then neutralized with an appropriate base such as alkali metal hydroxide or ammonium hydroxide to produce the desired salt. Although the alkaline earth metal salts are generally discussed in prior literature such are less preferred in connection with the present invention. Preferred salt cations are sodium and potassium, especially the former.

AMIDE COMPONENT

The amide component used in formulations in accordance with the present invention are fatty acid amides and fatty acid mono- and di-lower alkanol or alkyl amides having from about 10 to about 14 carbon atoms in the fatty acid (acyl) groups, particularly those having also lower alkanol groups or lower alkyl groups of from 2 to 6 carbon atoms such as lauryl monoethanol amide, myristyl diethanol amide, myristyl mono isopropanol amide and lauryl diisopropanol amide. In such amides, the acyl groups present are preferably pure individual or mixed coconut range acyls, typically a mixed acyl distribution of a whole cut coconut oil or of a center cut coconut oil.

Suitable amides for detergent usuage and their methods of production are well known to those skilled in the art as shown, for example, by U.S. Pat. Nos. 2,607,740 and 3,332,878, both of which, like all other patents and literature cited herein are herewith incorporated by reference.

AMINE OXIDE COMPONENT

Amine oxides suitable for use in the compositions of the present invention are conventional detergent components whose structures and methods of preparation are well known to those skilled in the art as disclosed for example by U.S. Pat. Nos. 2,169,976; 3,001,945; 3,234,282; 3,317,430; 3,397,239; and by Canadian Patent No. 847,303.

Typical and preferred amine oxides are long chain dimethyl amine oxides such as lauryl dimethyl amine oxide and myristyl dimethyl amine oxide.

MISCELLANEOUS DETERGENT COMPONENTS

In preferred detergent compositions of the present invention a coupling agent is used which preferably is a lower alkanol having up to about 6 carbon atoms per molecule. A preferred alkanol is ethyl alcohol. Other suitable alkanols include normal propyl alcohol, isopropyl alcohol, butyl alcohols, amyl alcohols, and hexyl alcohols. The coupling agent is used in proportions of up to about 15 percent by weight based on the composition, more preferably from about 2 to about 10 percent by weight, on the same basis.

The lower alkanol described as useful as a coupling agent, typically ethanol, may be replaced wholly or partially by humectants such as propylene glycol, hexylene glycol, glycerine and sorbitol.

The bottle-cap dispenser is a widely-used type of dispenser that is prone to pluggage due to the formation of gels with olefin sulfonates. To hold costs low, this dispenser usually contains a simple arrangement of a flow passage having a diameter of several millimeters up to about 10 to 20 millimeters, typically 5 millimeters. The small diameter and exposed position relative to air provides a particularly adverse combination of conditions prone to gellation.

The following examples indicate preferred embodiments of the present invention.

EXAMPLE I

A sample of crude sulfonated olefin was produced by reacting a mixture of predominantly tetradecenes and hexadecenes in a 2:1 weight ratio with about 1.1 mol of $SO_3$ per mol of olefin in a falling film reactor at a temperature of about 50° C. The olefins used were as follows:

| | Weight Percent |
|---|---|
| Dodecenes | 0.3 |
| Tetradecenes | 65.7 |
| Hexadecenes | 34.0 |
| Average Number of Carbon Atoms per Molecule | 14.6 |
| Average Molecular Weight | 205 |
| | Mol Percent |
| Vinyl olefins | 80 |
| Vinylidene olefins | 14 |
| Internal olefins | 6 |

The olefins were obtained by displacement of the product of chain growth of ethylene on triethyl aluminum.

To a 4-liter stainless steel beaker was added 815 grams of the above crude sulfonated olefins, 245 grams of NaOH solution (49.3 wt. percent NaOH in water), 45 grams of sodium formate and 396 grams of water. The system was intimately mixed at about room temperature using a homogenizer mizer. Heat of neutralization produced a moderate heat rise.

The mixed system was transferred to a 4-liter wide mouth stainless steel pressure vessel connected to a Zenith positive displacement pump through a short length of ¼ inch diameter teflon tubing. The pressure vessel was closed and then pressured with nitrogen to feed the pump. The pump discharged into a heated ½ inch i.d. stainless steel tube about 17.6 feet long of about 500 cc volumetric capacity. The volumetric delivery of the pump was adjusted to provide 30 minutes residence time in the tube. The tubing was electrically heated for all but the last foot of its length to a selected operating temperature of about 140°–150° C. The remaining foot of the tube was exposed to the air to act as a cooler providing a discharge temperature of about 80° C to minimize flashing. At the end of the tube was placed a pressure relief valve set at about 100 psig. The product, of the consistency of syrup, emerged from the relief valve at the end of the tube and was caught in a beaker. The pressure at the pump discharge was about 120 psig indicating a 20 psig pressure drop through the tube.

The product analyzed as follows:

| | |
|---|---|
| $H_2O$, wt. percent | 36.3 |
| $Na_2SO_4$, wt. percent | 0.41 |
| NaOH, wt. percent | 0.44 |
| Free oil, wt. percent | 1.90 |
| Sodium formate, wt. percent | 2.8 |
| Olefin sulfonate, sodium salt, wt. percent | 58.2 |

The sodium formate content shown as 2.8 percent was based on NMR (nuclear magnetic resonance) analysis. Based on the weight of the sodium formate added, the sodium formate content was 3.0 percent. The olefin sulfonate salt figure was obtained by difference.

The product viscosity was measured at 50, 60, and 70° C using a Haake Rotovisco rotating viscosimeter. Viscosity data were plotted in FIG. 1 of the drawing. This material is non-Newtonian so that the apparent viscosity in centipoises is given by the relationship:

$$\frac{\text{shear stress}}{\text{shear rate}} \times 100$$

At a typical shear rate of 23 $sec^{-1}$common to all measurements, the apparent viscosities for 50, 60 and 70° C were 1070, 648 and 357 centipoises, respectively.

EXAMPLE II

Example I was repeated using 949 grams of the crude sulfonated olefins, 273 grams of 49.3 percent NaOH solution, 75 grams of sodium formate and 235 grams of water.

In this instance, the hydrolysis was performed using 600–700 grams of the mixed feed material in a 1-liter Parr autoclave. The material was placed in the autoclave, the autoclave closed, the temperature raised slowly over 3–4 hours to 150°–160° C and held at 160° C for 1 hour. The autoclave was then placed in a water bath and cooled to 70° C. The autoclave was opened and the contents poured into a plastic bottle and tested for viscosity as in Example I.

The product analyzed as follows:

| | |
|---|---|
| $H_2O$, wt. percent | 26.3 |
| $Na_2SO_4$, wt. percent | 0.56 |
| NaOH, wt. percent | 0.03 |
| Free oil, wt. percent | 1.18 |
| Sodium formate, wt. percent | 4.8 |
| Olefin sulfonate salt, wt. percent | 67.1 |

Figure 2:
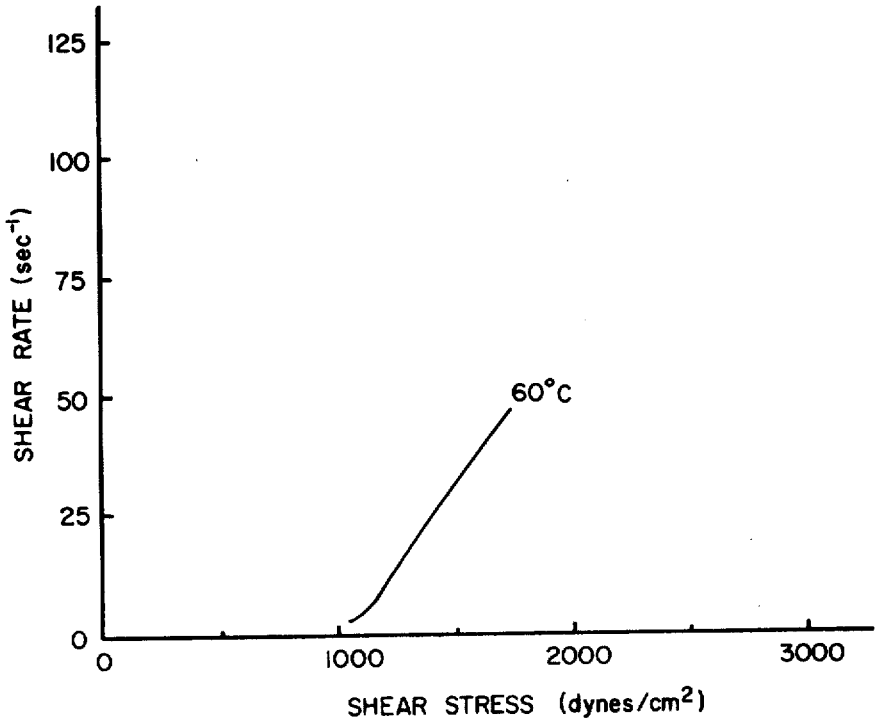

Apparent viscosity was measured as in Example I but at 60° C only. Data taken are shown in FIG. 2. At the typical shear rate of 23.0 $sec.^{-1}$, the apparent viscosity was 6043 cps. Although this viscosity is higher than the comparable viscosity of the 58.2 percent AOS material of Example I, this material is readily handled as a fluid.

EXAMPLE III

In a comparative example, Example I was repeated omitting the sodium formate. Problems appeared immediately. Mixing of the feed materials was difficult. The feed to the Zenith pump through the ¼ inch tube was difficult. Pressure drop across the ½ inch tube was in excess of 500 psig (compared to the 20 psig of Example I). The product discharged from the pressure relief valve was a pasty solid that did not flow to form a smooth layer in a containing receptacle even after standing for several weeks. The material was too viscous to test in the Haake viscosimeter; consequently, it was tested in an extrusion rheometer at room temperature. An apparent viscosity of 88,000 centipoises at a shear rate of 68.2 $sec^{-1}$ was indicated. It was concluded that the products of Examples I and II were much easier to produce and handle than the product of Example III. Since the product of Example III would not flow it was considered to be unsuitable for transportation in bulk since withdrawal from containers such as railroad tank cars is too difficult.

EXAMPLE IV

A sample of sodium salt of sulfonic acid having predominantly 16 and 18 carbon atoms per molecule was prepared as follows:

Olefins of the following composition were sulfonated with 1.10–1.15 mols of $SO_3$ per mol of olefin in a falling film reactor at about 40° C and the product batch hydrolyzed in a conventional manner using a slight excess of NaOH at about 150° C in a pressure vessel for a contact time of about 30 minutes:

| | Wt. Percent |
|---|---|
| Tetradecenes | 1 |
| Hexadecenes | 52 |
| Octadecenes | 42 |
| Eicosenes | 5 |
| | 100 |
| Average molecular weight | 237 |
| Average number of carbon atoms per molecule | 17.0 |
| | Mol Percent |
| Vinyl olefins | 62.6 |
| Vinylidene olefins | 24.2 |
| Internal olefins | 13.2 |
| | 100.0 |

The sulfonate salt product had the following analysis:

| | |
|---|---|
| $H_2O$, wt. percent | 65.1 |
| $Na_2SO_4$, wt. percent | 1.61 |
| NaCl, wt. percent | 1.55 |
| NaOH, wt. percent | 0.04 |
| Free oil, wt. percent | 1.17 |
| Sodium formate | 0 |
| Sulfonic acid salts, wt. percent (by difference) | 30.5 |

The viscosity as measured by a Brookfield viscosimeter was as follows:

| | |
|---|---|
| 30° C | 69,700 centipoises |
| 60° C | 5,870 centipoises |
| 90° C | 665 centipoises |

The viscosity as measured by the Haake Rotating Viscosimeter was:

6600 centipoises at 23 $sec^{-1}$ shear rate at a temperature of 60° C.

400 Grams of the foregoing 30.5 sulfonic acid salt and 10 grams of sodium formate were combined at room temperature and the temperature raised slowly. Initially the mixture was highly viscous but after a brief period the viscosity decreased considerably.

Figure 3:
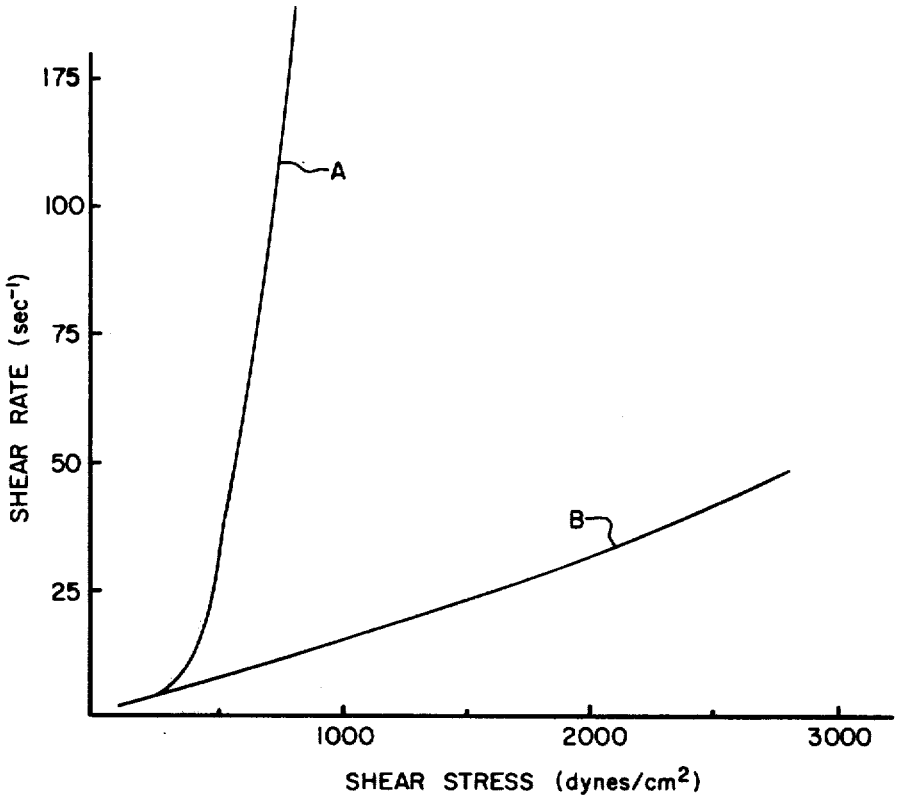

Heating was continued while water was removed forming a more concentrated system. When the sulfonate salt concentration reached 50 wt. percent, the heating was stopped and the viscosity determined as in Example I. Data taken are shown in FIG. 3, wherein Curve A is a plot of the viscosity characteristics of the 50 percent sulfonate salt system containing 4.1 percent sodium formate and Curve B is a plot of the 30.5 percent sulfonate salt starting material prior to the addition of sodium formate and the evaporation of water.

As measured on the Haake Rotating Viscosimeter, the apparent viscosity was 2000 centipoises at 23 $sec^{-1}$ shear rate at a temperature of 60° C. This is obviously less than the apparent viscosity of 6600 at the same shear rate and temperature obtained with the starting 30.5 percent sulfonate salt system even though the product material had far less water.

Comparative analysis of the 50 percent sulfonate salt system containing sodium formate was as follows:

| | |
|---|---|
| $H_2O$, wt. percent | 38.7 |
| $Na_2SO_4$, wt. percent | 2.64 |
| NaCl, wt. percent | 2.54 |
| NaOH, wt. percent | 0.07 |
| Free oil, wt. percent | 1.92 |
| Sodium formate, wt. percent | 4.1 |
| Sulfonic acid salts, wt. percent (by difference) | 50.0 |

EXAMPLES V–VIII

To show the body enhancing effect of the carboxylic acid salts in olefin sulfonate detergent formulations, combinations of olefin sulfonate (AOS), alcohol ethoxy sulfates (AES), alkyl dimethyl amine oxide (LDMAO), amide (LMMEA, LMDEA, LIPA), sodium formate and water were made and tested for viscosity using a Haake Rotovisco rotary viscosimeter. Table I shows various proportions and combinations of components and corresponding test results. The amounts of the ingredients used are on a weight percent basis. The results indicate that high viscosity formulations suitable for liquid shampoo and bubble bath concentrates are obtained even with only 5 percent AOS content through the use of carboxylic acid salts. Synergism is apparent in the combination of olefin sulfonate (salts), carboxylic acid salts and amine oxide or amide. The formate salt thus provides significantly increased viscosity for the dilute formulations having from about 5 to about 20 percent of olefin sulfonate salt.

The olefin sulfonate used was a 2/1 $C_{14}/C_{16}$ olefin derivative similar to that used in Example I wherein the olefin was obtained by displacement of the product of chain growth of ethylene on triethyl aluminum was sulfonated with gaseous $SO_3$ and the crude sulfonated olefins hydrolyzed with NaOH.

Sulfonation procedure was similar to that used for the similar olefins of Example I. The crude sulfonated olefins were batch-hydrolyzed at 90°–100° C for 8 hours with a slight excess of aqueous NaOH to produce product aqueous sulfonate salt with a concentration of about 38 percent by weight. The sulfonate salt was bleached by treatment with 1 wt. percent of sodium hypochlorite (based on AOS content) at 50° C for about 15 minutes.

The alkyl ether sulfate (AES) was Alfonic 14–12A ether sulfate manufactured by Continental Oil Company. It is based on 3 mols ethoxylate of a mixture of mainly dodecanol and tetradecanol in a 40/60 ratio by weight, as the ammonium salt.

The amine oxide (LDMAO) was Aromox (Armour Industrial Chemical Co.) DMMCDW containing 1.0 percent $C_{10}$, 70.0 percent $C_{12}$, 24 percent $C_{14}$, 5 percent $C_{16}$ by weight distribution of the long chain alkyl groups. The short chain alkyl groups were methyl.

Monoethanol amide (LMMEA) was Stepan product. The long chain alkyl groups are mainly $C_{12}$ and $C_{14}$ in approximate ratio of 70/30.

Diethanol amide (LMDEA) was Stepan Ninol AA-62 Extra. The long chain fatty acid or acyl groups are mainly $C_{12}$ and $C_{14}$ in approximate ratio of 90/10.

Isopropanol amide (LIPA) was Stepan product. This is a mono isopropanol amide with $C_{12}$ long chain fatty acid groups.

The sodium formate used was 99 percent grade of Fisher Scientific Company.

TABLE I

APPARENT VISCOSITY OF OLEFIN SULFONATE-SODIUM FORMATE SYSTEMS WEIGHT PERCENT OF VARIOUS COMPONENTS

| EXAMPLE | V | V-A | V-B | VI | VI-A | VI-B | VII | VII-A | VII-B | VIII | VIII-A | VIII-B |
|---|---|---|---|---|---|---|---|---|---|---|---|---|
| AOS | 10 | 10 | 10 | 20 | 20 | 20 | 5 | 5 | 5 | 12 | 12 | 12 |
| Component C | | | | | | | | | | | | |
| AES | | | | | | | | | | 6 | 6 | 6 |
| LDMAO | | | | 3 | 0 | 3 | | | | | | |
| LMMEA | | | | | | | 1 | 0 | 1 | | | |
| LMDEA | 2 | 0 | 2 | | | | | | | | | |
| LIPA | | | | | | | | | | 2 | 0 | 2 |
| Sodium Formate | 5 | 5 | 0 | 3 | 3 | 0 | 5 | 5 | 0 | 4 | 4 | 0 |
| Water | 83 | 83 | 83 | 74 | 74 | 74 | 89 | 89 | 89 | 76 | 76 | 76 |
| AOS/Component C | 10/2 | 10/0 | 10/2 | 20/3 | 20/0 | 20/3 | 5/1 | 5/0 | 5/1 | 12/8 | 12/6 | 12/8 |
| AOS/Amide and Amine Oxide | 10/2 | 10/0 | 10/2 | 20/3 | 20/0 | 20/3 | 5/1 | 5/0 | 5/1 | 12/2 | 12/0 | 12/2 |
| AOS/Formate | 2 | 2 | 2 | 6.7 | 6.7 | 6.7 | 1 | 1 | 1 | 3 | 3 | 3 |
| AOS/Water | 10/83 | 10/83 | | 20/74 | | | 5/89 | | | 12/76 | | |
| Apparent Viscosity (centipoises at 25° C) | 1402 | — | 3 | 13,329 | 36 | 19 | 1074 | — | 2 | 3197 | 155 | 10 |

EXAMPLES IX–XVI

TABLE II

GEL INHIBITION WITH SODIUM FORMATE IN OLEFIN SULFONATE FORMULATIONS

| EXAMPLE | IX | X | XI | XII | XIII | XIV | XV | XVI |
|---|---|---|---|---|---|---|---|---|
| | Composition, wt. percent | | | | | | | |
| AOS | 20 | 20 | 7.5 | 7.5 | 30 | 30 | 15 | 15 |
| Component C | | | | | | | | |
| AES | 10 | 10 | 13 | | — | | 10 | 10 |
| LDMAO | — | | — | | 3 | 3 | — | — |
| LMDEA | — | | 3 | 3 | — | — | — | — |
| LMMEA | 4 | 4 | — | — | — | — | — | — |
| LIPA | — | — | — | — | — | — | 4 | 4 |
| Sodium Formate | 5 | — | .75 | — | 7 | — | 7 | — |
| Ethanol | 4 | 4 | 2 | 2 | 5.6 | 5.6 | 4 | 4 |
| Water | 57 | 62 | 86.75 | 87.5 | 54.4 | 61.4 | 60 | 67 |
| AOS/Component C | 20/14 | 20/14 | 7.5/3 | 7.5/3 | 30/3 | 30/3 | 15/14 | 15/14 |
| AOS/Amide and Amine Oxide | 20/4 | 20/4 | 7.5/3 | 7.5/3 | 30/3 | 30/3 | 15/4 | 15/4 |
| AOS/Formate | 4/1 | 20/0 | 10/1 | 7.5/0 | 30/7 | 30/0 | 15/7 | 15/0 |
| AOS/Water | 20/57 | 20/62 | 7.5/87 | 7.5/87.5 | 30/54.4 | 30/61.4 | 15/60 | 15/67 |
| Gel Rating | None | Gelled | None | None | None | Gelled | None | Gelled |

To show the anti-gel effect of the carboxylic acid salts in olefin sulfonate detergent formulations, additional formulations having a generally higher olefin sulfonate content than those of Examples V–VIII were produced and tested and results tabulated in Table II. Components of the formulations are as identified herein before.

The gel rating was obtained by observing the surface of the formulation exposed to air for formation of a skin and the bulk of the liquid for gel formation. After 24 hours, the sample was evaluated to determine if a gel had formed as a skin on the surface or if the entire mass had gelled. These examples are grouped in a comparative pairs to show the general effectiveness of the carboxylic acid salt to suppress gelling tendencies of the olefin sulfonate salts for a wide variety of co-present materials used to make detergent formulations.

Examples XI and XII show that the more dilute systems are less prone to gelling since neither showed any sign of gelling at 24 hours. In this instance the time was then extended to 4 days, at the end of which time the sample of Example XI containing the carboxylic acid salt was still a pourable fluid while the sample of Example XII was a gel that would not pour from the beaker. Although this prolonged test involved incidental evaporation of water producing a localized system which probably became more concentrated than the initial 7.5 percent olefin sulfonate salt, the test is realistic for evaluation of gelling propensity in the bottle cap because evaporation usually is a factor there also.

EXAMPLES XVII–XXVII

The following salts were tested for viscosity control of olefin sulfonate detergent formulations and the results tabulated in Table III. The formulation used for this series contained on a weight basis, 10 percent of the olefin sulfonate of Examples V–VIII, 2 percent of lauric/myristic diethanol amide (Stephan Ninol AA62 Extra), 5 percent of the carboxylic acid salt under test, and balance water. Viscosity measurements are on the same basis as Examples V–VIII. The sodium formate used in this series was Hercules sodium formate, (97 percent sodium formate). It is evident that sodium formate and sodium acetate are superior to the others tested.

TABLE III

| Example | Thickener | Apparent Viscosity Centipoises (25° C) |
|---|---|---|
| XVII | Sodium Formate | 1636 |
| XVIII | Sodium Acetate | 1138 |
| XIX | Sodium Propionate | 273 |
| XX | Sodium Chloroacetate | 75 |

TABLE III-continued

| Example | Thickener | Apparent Viscosity Centipoises (25° C) |
|---|---|---|
| XXI | Sodium Acrylate | 120 |
| XXII | Disodium Malonate | 129 |
| XXIII | Disodium Maleate | 118 |
| XXIV | Disodium Fumarate | 330 |
| XXV | Sodium Benzoate | 6 |
| XXVI | Disodium Phthalate | 30 |
| XXVII | Sodium Citrate | 23 |

EXAMPLES XXVIII–XXXVIII

The following salts were tested for gel inhibition in olefin sulfonate detergent formulations. Gel rating was obtained as described in connection with Examples IX–XVI. Several salts were found to be good performers in this respect; however, one usually prefers systems which also are good in regard to viscosity control so that a single high-active concentrate can be used that will provide the best overall results. The formulations used for this series contained, on a weight basis, 20 percent of the olefin sulfonate described for Examples V–VIII, 10 percent of the AES described for Examples V–VIII, 4 percent of lauric myristic monoethanol amide (Stepan), 4 percent of the gel inhibitor salt as specified, 4 percent ethanol, balance water.

TABLE IV

| Example | Gel Inhibitor | Gel Rating |
|---|---|---|
| XXVIII | Sodium Formate | None |
| XXIX | Sodium Acetate | None |
| XXX | Sodium Propionate | None |
| XXXI | Sodium Chloroacetate | Slight |
| XXXII | Sodium Acrylate | None |
| XXXIII | Disodium Malonate | None |
| XXXIV | Disodium Maleate | None |
| XXXV | Disodium Fumarate | None |
| XXXVI | Sodium Benzoate | Gelled |
| XXXVII | Disodium Phthalate | Slight |
| XXXVIII | Sodium Citrate | None |

We claim:

1. A composition of matter consisting essentially of, on weight percent basis:

A. from about 50 to about 70 percent of olefin sulfonate having from about 10 to about 24 carbon atoms per molecule, B. from about 3 to about 50 percent of salt of the formula HCOOM wherein M is alkali metal, ammonium, lower alkanol ammonium or lower alkyl ammonium, and C. from about 5 to about 57 percent water.

2. The composition of claim 1 wherein on a weight percent basis

A. is from about 50 to about 70 percent,

B. is from about 3 to about 25 percent, and

C. is from about 10 to about 47 percent.

3. The composition of claim 1 wherein on a weight percent basis

A. is from about 60 to about 70 percent,

B. is from about 4 to about 10 percent, and

C. is from about 20 to about 36 percent.

4. The composition of claim 1 wherein B is an alkali metal salt.

5. The composition of claim 1 wherein B is sodium formate.

6. A composition in accordance with claim 1 wherein the amount of A is from about 60 to about 70 percent.

7. A composition in accordance with claim 1 wherein the amount of B is from about 3 to about 25 percent.

8. A composition in accordance with claim 1 wherein the amount of B is from about 4 to about 10 percent.

9. A composition in accordance with claim 1 wherein the amount of water is from about 10 to about 47 percent.

10. A composition in accordance with claim 1 wherein the amount of water is from about 20 to about 36 percent.

11. A process for producing an olefin sulfonate salt system which comprises reacting from about 0.85 to about 1.3 mols of $SO_3$ with about one mol of olefin having from about 10 to about 24 carbon atoms per molecule at a temperature of about 0° C to about 100° C over a period of about 0.1 to about 60 seconds to obtain a sulfonation addition product, and then in a second step reacting sulfonation addition product with aqueous sodium, potassium or ammonium hydroxide in the presence of an ammonium, lower alkanol ammonium, lower alkyl ammonium or alkali metal formate salt, the amount of water present in the system at the second step ranging from about 5 to about 57 percent by weight, the amount of formate salt being controlled to provide a weight ratio of olefin sulfonate salt to formate salt ranging from about 70:3 to about 1:1.

12. The process of claim 11 wherein the hydroxide is sodium hydroxide or potassium hydroxide and the formate salt is sodium or potassium formate.

* * * * *